US007100243B1

(12) United States Patent
Platzke

(10) Patent No.: US 7,100,243 B1
(45) Date of Patent: Sep. 5, 2006

(54) GATE HINGE WITH LOCKING PIN

(76) Inventor: Mason F. Platzke, 22542 Dover Bridge Rd., Preston, MD (US) 21655

( * ) Notice: Subject to any disclaimer, the term of this patent is extended or adjusted under 35 U.S.C. 154(b) by 0 days.

(21) Appl. No.: 11/146,836

(22) Filed: Jun. 7, 2005

(51) Int. Cl.
*E05D 11/10* (2006.01)

(52) U.S. Cl. ..... 16/326; 16/229; 16/86.1; 403/84; 403/968

(58) Field of Classification Search ..... 16/326, 16/261, 253, 270, 229, 86.1, 86.2, 324, 260, 16/352, 353, 374, 345, 347; 296/146.11; 49/394; 292/300, 302, 292, 295, DIG. 17; 403/84, 96, 83, 92; 256/67, 65.13
See application file for complete search history.

(56) References Cited

U.S. PATENT DOCUMENTS 146,776 A 1/1874 Nichols
2,186,789 A * 1/1940 Rosenberg ..... 16/229
2,799,888 A * 7/1957 White ..... 16/375
3,204,606 A * 9/1965 Parr et al. ..... 119/514
3,987,516 A 10/1976 Winsor
D277,453 S 2/1985 Wilman
4,501,045 A * 2/1985 Boyer ..... 16/331
4,697,306 A * 10/1987 Rhodes ..... 16/317
5,173,993 A 12/1992 Baker
5,224,241 A 7/1993 Williams
5,666,695 A 9/1997 Jegers
5,887,317 A 3/1999 Baker
6,715,182 B1 * 4/2004 Cheng ..... 16/280

* cited by examiner

*Primary Examiner*—Chuck Y. Mah
*Assistant Examiner*—Mark T. Vogelbacker
(74) *Attorney, Agent, or Firm*—Lawrence J. Gibney, Jr.

(57) ABSTRACT

This is a device, which will allow a gate to be closed or open or set in a position to provide a means of ingress and egress to a particular facility. This would include warehouses, maintenance yards, farms and any sort of delivery facilities and other industrial sites.

3 Claims, 3 Drawing Sheets

GATE HINGE WITH LOCKING PIN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This device allows a gate to lock in a certain position. It will eliminate the need for a tie device or post to maintain the position of the gate.

B. Prior Art

At times it is important in terms of safety to be able to open a gate and keep it open in one position. This idea may also be important in warehouses or similar facilities when deliveries are being made. This concept can also be used in mechanisms to keep car hoods open as well.

A representative example of the prior art in this area is Winsor, U.S. Pat. No. 3,987,516. This comprises a latch bracket and a base bracket and is typically used in the automotive industry. The present application has much more utility in terms of multiple applications such as maintenance yards, warehouse facilities, or farms.

Other examples of the prior art include Baker, U.S. Pat. No. 5,173,993 and Jegers, U.S. Pat. No. 5,666,695. Unlike the current device none of the prior art solves the problem of being able to maintain the "open" position of the gate.

BRIEF SUMMARY OF THE INVENTION

There is a need to maintain a gate in a completely open configuration. This enables deliveries to be made without having to continually open the gate. It may also be used in other applications, which may not be specifically mentioned in this application.

The device consists of a top hinge and a bottom hinge, which are welded to a gate upright or "post" on one surface and a gate on the other surface.

A bottom hinge is included and, like the top hinge, is welded to the gate upright and gate. A pin, which rotates within the top hinge is configured to fit within a hole or indentation and "lock" the gate into position.

This device allows the gate to maintain an "open" or "closed" position by simply positioning the pin in the appropriate hole. A handle is provided to position the pin within the device.

The top hinge is constructed with a plurality of holes and a locking pin with a handle to maintain the position of the gate. The parts of the bottom hinge must be allowed to rotate relative to each other but the bottom hinge is not equipped with a handle and locking mechanism and does not serve to lock the gate in position.

Due to the exposure of this device to various environments, and the need to support the weight of the gate, it should be constructed of durable material. Steel is probably the preferred material although aluminum may also be used.

DETAILED DESCRIPTION OF THE EMBODIMENTS

Figure 1:
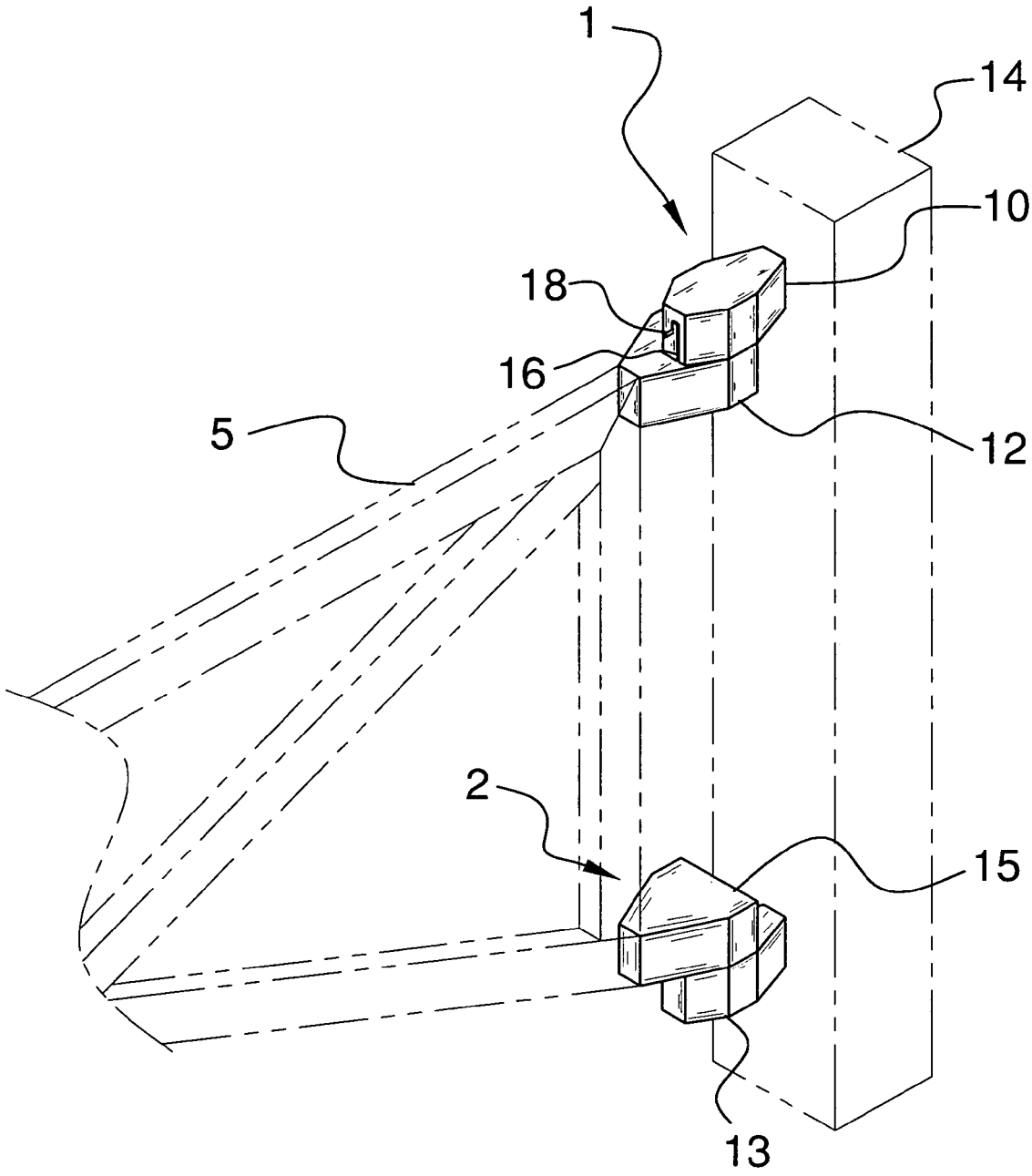
FIG. 1 is a perspective view of the device in use.

The device is comprised of two separate hinges: a bottom hinge 2 and a top hinge 1. Each respective hinge has a bottom portion and a top portion. Both hinges are secured to the gate upright or post 14. It is anticipated that this device will allow a gate to rotate approximately one hundred eighty degrees and be locked into position.

The top hinge 1 has a top part 10 and a bottom part 12. The bottom hinge 2 also has a top part 15 and a bottom part 13. Although each hinge has two parts, the respective parts are different in construction.

With respect to the top hinge 1, one surface of the top part 10 is secured to the gate upright 14 and will secure that part of the hinge to the post 14. The means to secure will most likely be welding although other means may be used. The bottom part 12 of the top hinge 1 is connected to the underside of the top part 10 and is allowed to rotate freely and is secured to the gate 5. It allows the gate 5 to be opened and closed. A locking pin 24 with a handle 18 is provided on the top part 10 of the top hinge 1. Within the in interior of the top hinge 1 is a plurality of hinge pin holes 22 on the bottom part of the top hinge to allow the gate 5 to be locked into position using the locking pin 24 within the top hinge 1. FIG. 1. The handle 18 moves up and down in the slot 16, which is provided for that purpose. The slot is fashioned to resemble an inverted "J" and when the gate 5 is in its correct position, the handle is inserted into the leg of the inverted J.

This structure allows the locking pin 24 to be inserted into the appropriate hinge pin hole 22 to enable the gate to be locked into position. It is anticipated that there are three separate hinge pin holes: one on either end and one in the middle. This particular placement of the hinge pin holes would enable the gate to be locked into position vertical to the post in two positions and horizontal to the gate. A separate hinge pin 20 connects the two parts of the top hinge 1. A corresponding locking pin 24, which has a tapered point, can be placed in the appropriate hinge pin hole 22 on the bottom part of the top hinge to lock the gate into position.

A handle 18 is provided to allow the locking pin 24 to be lifted from the hole 22 and the gate 5 to be rotated. The handle extends a predetermined distance perpendicular to the locking pin and its diameter is less than the width of the slot 16. Likewise the diameter of the locking pin 24 is less than the diameter of the hinge pin holes 22 into which the locking pin 24 is inserted to secure the gate 5 in position.

Figure 2:
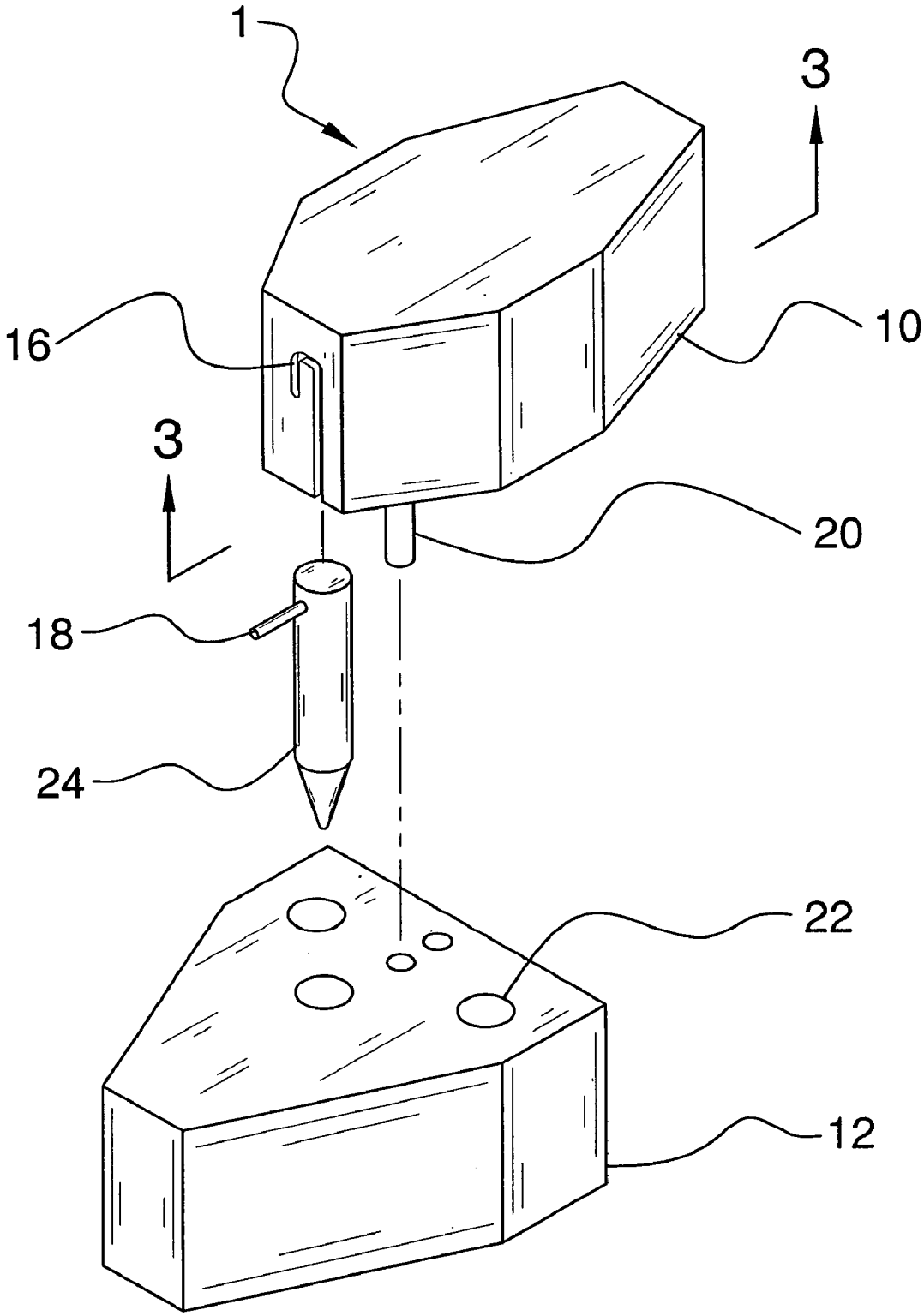
FIG. 2 is an exploded view of the top hinge.
Figure 3:
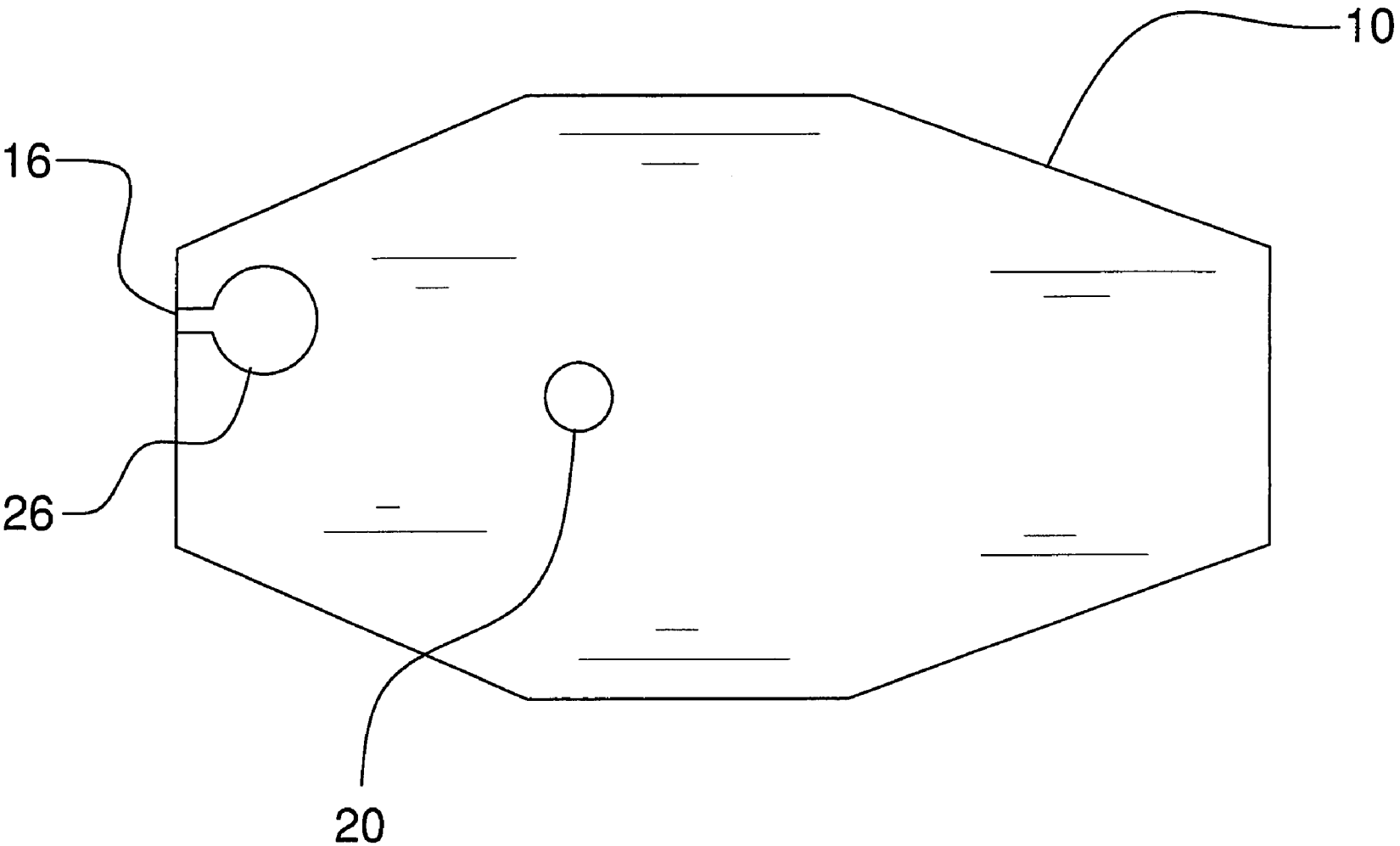
FIG. 3 is a view along line 3—3 on FIG. 2.

The bottom hinge 2 is equipped with two parts: a top part 15 and a bottom part 13. The top part 15 and the bottom part 13 are connected to each other. One surface of the bottom part 13 is secured to the gate post 14 and a surface of the top part 15 is secured to the gate 5. The two parts of the bottom hinge are equipped with a means to allow rotation of these parts, most likely by means of a hinge pin 20 as depicted in FIG. 2. Unlike the top hinge, the bottom hinge pin does not have any mechanism to allow the gate 5 to lock into position. For that reason the bottom hinge, unlike the top hinge, does not have a slot and handle or the plurality of holes other than the hole for the hinge pin as shown in FIG. 2.

Because of the exposure of this device to all environments, it should be constructed from durable material such as steel or aluminum.

While the embodiments of the invention have been disclosed, certain modifications may be made by those skilled in the art to modify the invention without departing from the spirit of the invention.

The invention claimed is:

1. A device to lock a gate in place, which is comprised of:

a. a top hinge structure;

said top hinge structure has a top part and a bottom part;

said top part is secured to a post;

said bottom part is secured to a gate;

wherein a means of connection secures the top part to the bottom part;

wherein the top part and the bottom part permit rotation relative to each other;

b. a hinge pin;

wherein said hinge pin secures the top part and the bottom part of the top hinge structure;

c. a locking pin;

said locking pin has a first end and a second end;

wherein a handle is secured to a part of the first end of the locking pin;

wherein the second end has a tapered point;

said second end of the locking pin is inserted into one of a series of locking pin holes on the top surface of the bottom part of the top hinge structure;

d. the handle;

said handle travels in a slot on the top part of the top hinge structure provided for that purpose;

said handle permits movement of the locking pin;

e. the slot;

wherein the slot is provided on the top part of the top hinge structure;

wherein the slot is in the shape of an inverted "J";

f. the plurality of locking pin holes;

wherein the second end of the locking pin is inserted into one of the locking pin holes;

wherein the locking pin holes are provided at different positions on the top surface of the bottom part of the top hinge structure;

g. a bottom hinge structure;

said bottom hinge structure has a top part and a bottom part;

wherein a means of connection secures said top part to said bottom part;

wherein the top part and the bottom part of the bottom hinge structures are permitted to rotate relative to each other;

said top part of the bottom hinge structure is secured to the gate;

said bottom part of the bottom hinge structure is secured to the post;

h. the post;

wherein the post is provided to secure the gate;

said post is secured to a ground structure;

i. the gate;

wherein the gate is provided;

said gate has a first end and a second end;

said gate is of predetermined length.

2. The device as described in claim 1 wherein three locking pin holes are used.

3. The device as described in claim 1 wherein the locking pin holes are positioned to allow the gate to rotate approximately one hundred eighty degrees.

* * * * *